US008225574B2

(12) United States Patent
Croskrey

(10) Patent No.: US 8,225,574 B2
(45) Date of Patent: Jul. 24, 2012

(54) METHODS OF AND APPARATUSES FOR HARDWOOD FLOOR INSTALLATION

(76) Inventor: Wesley J. Croskrey, Fremont, CA (US)

( * ) Notice: Subject to any disclaimer, the term of this patent is extended or adjusted under 35 U.S.C. 154(b) by 0 days.

(21) Appl. No.: 11/581,019

(22) Filed: Oct. 14, 2006

(65) Prior Publication Data

US 2007/0094981 A1 May 3, 2007

Related U.S. Application Data

(60) Provisional application No. 60/727,179, filed on Oct. 14, 2005.

(51) Int. Cl.
*E04C 3/00* (2006.01)

(52) U.S. Cl. ..... 52/592.1; 52/578

(58) Field of Classification Search ..... 52/390, 52/392, 314, 403.1, 592.1, 578
See application file for complete search history.

(56) References Cited

U.S. PATENT DOCUMENTS

| | | | | | |
|---|---|---|---|---|---|
| 714,987 | A | * | 12/1902 | Wolfe | 52/578 |
| 1,124,228 | A | * | 1/1915 | Houston | 403/381 |
| 4,416,100 | A | | 11/1983 | Troendle, Sr. | |
| 4,644,720 | A | | 2/1987 | Schneider | |
| 4,703,597 | A | * | 11/1987 | Eggemar | 52/220.2 |
| 5,058,349 | A | * | 10/1991 | Conrad | 52/392 |
| 5,755,068 | A | * | 5/1998 | Ormiston | 52/314 |
| 5,797,237 | A | * | 8/1998 | Finkell, Jr. | 52/589.1 |
| 5,968,630 | A | * | 10/1999 | Foster | 428/77 |
| 6,021,615 | A | * | 2/2000 | Brown | 52/392 |
| 6,023,900 | A | * | 2/2000 | Stoehr et al. | 52/403.1 |
| 6,119,423 | A | * | 9/2000 | Costantino | 52/390 |
| 6,148,884 | A | | 11/2000 | Bolyard et al. | |
| 6,182,413 | B1 | | 2/2001 | Magnusson | |
| 6,237,295 | B1 | * | 5/2001 | Ballard | 52/589.1 |
| 6,601,359 | B2 | * | 8/2003 | Olofsson | 52/588.1 |
| 6,769,218 | B2 | * | 8/2004 | Pervan | 52/591.4 |
| 6,804,926 | B1 | * | 10/2004 | Eisermann | 52/592.1 |
| 6,922,965 | B2 | * | 8/2005 | Rosenthal et al. | 52/592.1 |
| 7,065,935 | B2 | * | 6/2006 | Ralf | 52/747.1 |
| 7,121,058 | B2 | * | 10/2006 | Palsson et al. | 52/592.2 |
| 2002/0100242 | A1 | * | 8/2002 | Olofsson | 52/588.1 |
| 2004/0206038 | A1 | | 10/2004 | Stanchfield | |
| 2005/0055942 | A1 | | 3/2005 | Maelzer et al. | |
| 2005/0144880 | A1 | | 7/2005 | Bengry et al. | |

OTHER PUBLICATIONS

International Search Report & Written Opinion of the International Searching Authority for corresponding international application PCT/US06/40323. Jul. 13, 2007.
Results Obtained from USPTO Database.

* cited by examiner

*Primary Examiner* — Khoi Tran
*Assistant Examiner* — Jason Holloway
(74) *Attorney, Agent, or Firm* — Larry Williams

(57) ABSTRACT

Apparatuses for installing a wood floor at a job site. The apparatuses are configured as start courses, finish courses, or border courses for the wood floor. In one embodiment, the courses comprise hardwood tongue and groove strips or hardwood tongue and groove planks fastened together prior to installation in the floor. A preferred embodiment uses adhesive lamination of the tongue and groove of adjacent boards such as strips and planks. A method of installing a hardwood floor includes the step of using at least one start course, at least one finish course, or at least one border course as disclosed in this application. A hardwood floor according to one embodiment of the present invention includes at least one start course, at least one finish course, or at least one border course as disclosed in this application.

8 Claims, 10 Drawing Sheets

METHODS OF AND APPARATUSES FOR HARDWOOD FLOOR INSTALLATION

CROSS-REFERENCES

The present application claims benefit of U.S. Patent Application No. 60/727179, filed on 14 Oct. 2005, named inventor Wesley J. CROSKREY. The present application is related to U.S. Patent Application No. 60/727179, filed on 14 Oct. 2005, named inventor Wesley J. CROSKREY. The content of U.S. Patent Application No. 60/727179 is incorporated herein, in its entirety, by this reference.

TECHNICAL FIELD

This invention relates to methods of and apparatuses for installing hardwood floors. More specifically, this invention relates to methods and apparatus for starting portions, finishing portions, and bordering portions of installing a hardwood floor.

BACKGROUND

Hardwood floors have been in use for a very long time. They are highly regarded for their beauty. Traditional hardwood floors are well known for their durability and long lifetime. The methods of installing traditional hardwood floors have not experienced recent major improvements. The installation of hardwood floors tends to be highly labor-intensive. This is particularly true for aspects of the installation dealing with traditional starting courses, traditional finishing courses, and traditional bordering courses. Indeed, the traditional methods of installing starting courses and finishing courses offer few choices in tooling, thus making these installations more labor-intensive. In addition, the starting courses and finishing courses can also require the most precision and skill in order to produce a high-quality floor.

There is a need for improved methods and apparatuses for installing hardwood floors. Particularly, there is a need for improved methods and apparatuses for starting courses, finishing courses, and bordering courses for hardwood floors so that the labor requirements can be reduced while maintaining the installation of high-quality hardwood flooring.

SUMMARY

This invention seeks to provide methods and apparatuses that can overcome one or more problems related to installing hardwood floors. One aspect of the present invention is a method of installing start courses, finish courses, and border courses for a wood floor. Another aspect of the present invention comprises materials for starting courses, finishing courses, and bordering courses for wood floors. Still another aspect of the present invention is a wood floor.

For one embodiment, the courses comprise hardwood tongue and groove strips or hardwood tongue and groove boards fastened together prior to installation of the floor. A preferred embodiment uses adhesive lamination of the tongue and groove of adjacent strips or planks. A method of installing a hardwood floor includes the step of using at least one start course, finish course, and border course as disclosed in this application. A hardwood floor according to one embodiment of the present invention includes at least one start course, finish course, and border course as disclosed in this application.

It is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out aspects of the present invention. It is important, therefore, that the claims be regarded as including such equivalent constructions insofar as they do not depart from the spirit and scope of the present invention.

The above and still further features and advantages of the present invention will become apparent upon consideration of the following detailed descriptions of specific embodiments thereof, especially when taken in conjunction with the accompanying drawings.

Figure 1:
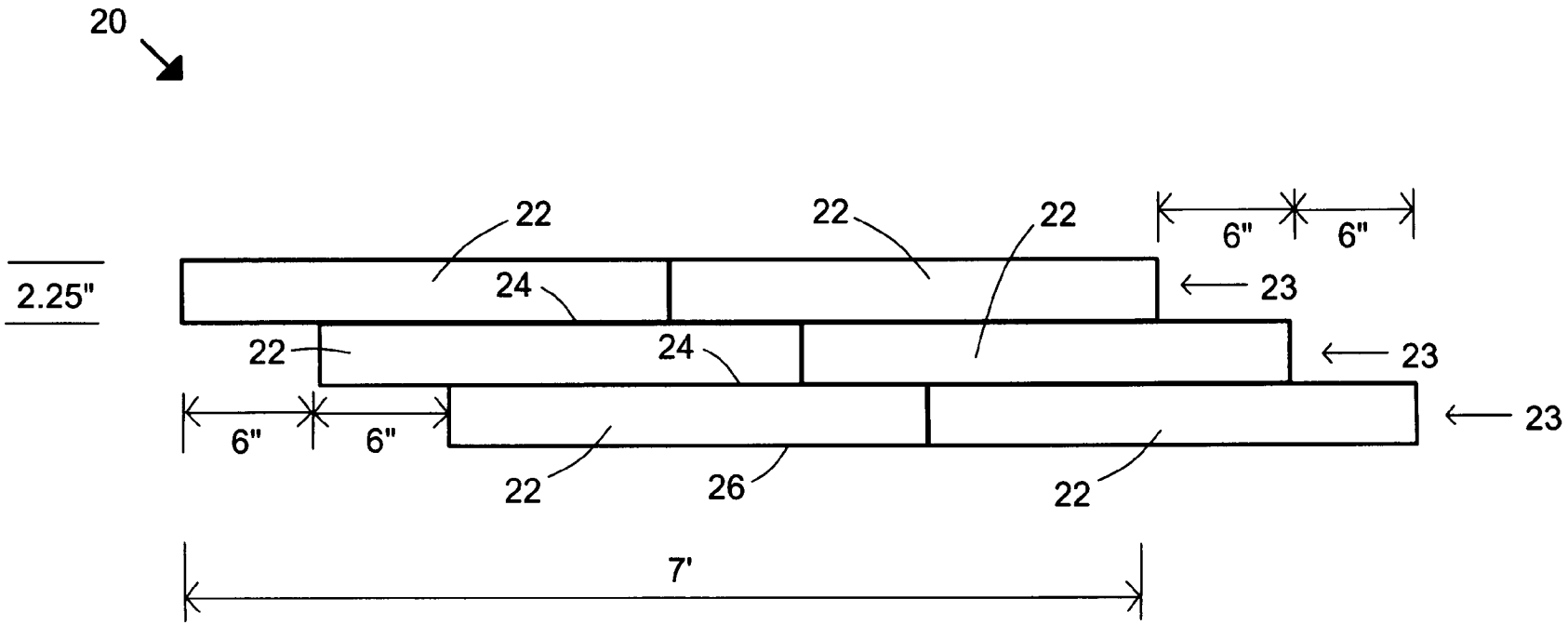
FIG. 1 is a diagram of a start course or finish course according to an embodiment of the present invention.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DESCRIPTION

The present invention pertains to the installation of hardwood floors. Embodiments of the present invention will be discussed below, primarily, in the context of installing hardwood floors in a standard home according to United States building codes and conventions. However, it is to be understood that embodiments in accordance with the present invention may be used for installing hardwood floors in substantially any type of building structure and according to building codes and conventions of other countries.

In the following description of the figures, identical reference numerals have been used when designating substantially identical elements or steps that are common to the figures.

Reference is now made to FIG. 1 where there is shown a top view of a start or finish course 20 according to one embodiment of the present invention for starting or finishing an installation of a hardwood floor. Course 20 uses 2.25 inch wide tongue and groove hardwood floor boards 22 in a pattern substantially as shown in FIG. 1. Each board 22 is laminated to the next with a 6 inch offset at each end row of boards 23. Each row of boards 23 is 7 feet long. The pattern of the boards in the course maintains a random installation pattern for the hardwood floor.

It is to be understood that other embodiments of the present invention include boards having widths other than 2.25 inches. Furthermore, other embodiments of the present invention include the row of boards 23 having lengths other than 7 feet. More specifically, the row of boards 23 may be longer than 7 feet or shorter than 7 feet. Preferably, the length of the row of boards 23 is selected so as to be more suitable for the size of the room for which the hardwood floor is being installed. Similarly, the number of boards in row of boards 23 is not limited to 2 boards. Row of boards 23 may have as few as one board that is the full length of the row. Alternatively, row of boards 23 may have 2, 3, or more boards in the row. The length of the boards and the number of boards is mainly a matter of designer choice so as to facilitate providing a random installation pattern for the hardwood floor.

For the embodiment shown in FIG. 1, course 20 uses six boards 22. In a preferred embodiment, course 20 uses boards that are 3.5 feet long for a total of about 7 feet for a pair of boards placed end to end. For this embodiment, course 20 is three 2.25 inch boards wide with a 6 inch offset at each end in the same direction.

Figure 1A:
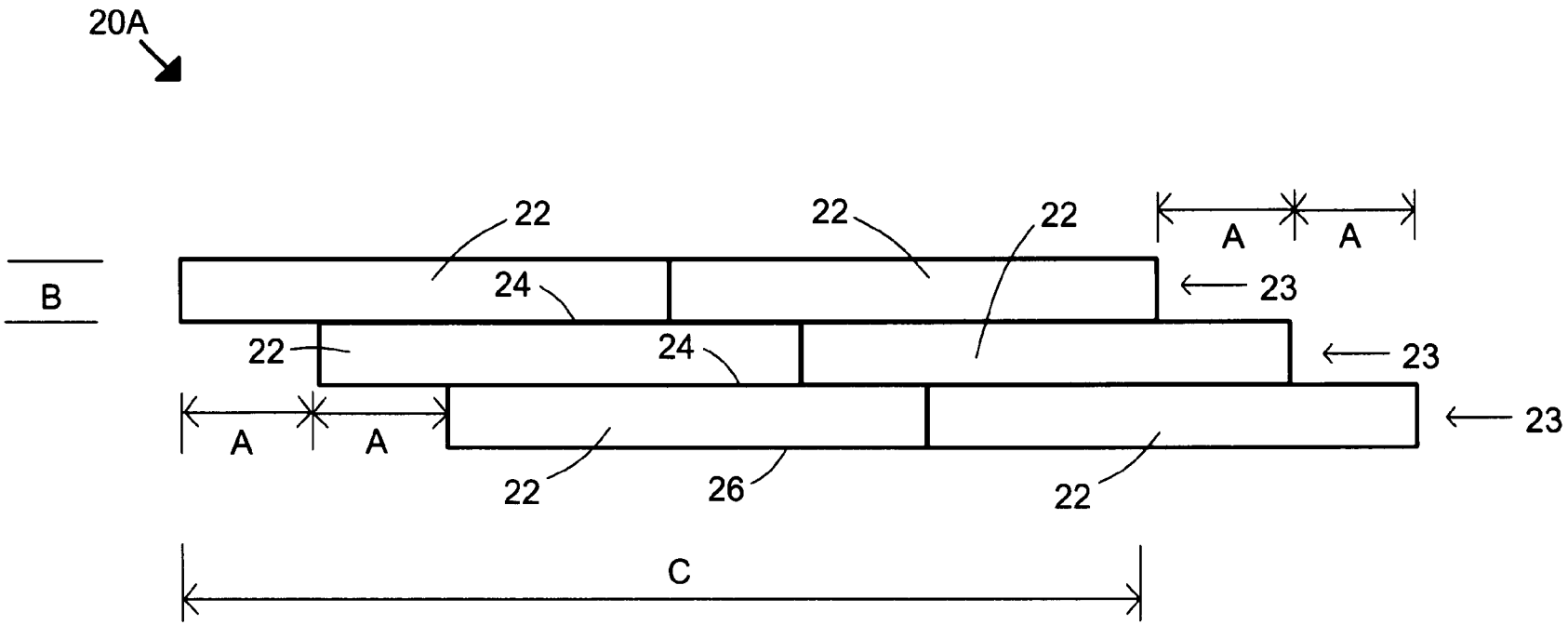
FIG. 1A is a diagram of a start course or finish course according to an embodiment of the present invention.

Reference is now made to FIG. 1A where there is shown a top view of a start or finish course 20A for a hardwood floor according to one embodiment of the present invention. The course comprises a plurality of elongated hardwood tongue and groove boards 22. For this embodiment, course 20A uses 6 boards. A first pair of the boards is disposed so as to provide end-to-end forming a row of boards 23, a second pair of the boards is disposed so as to provide end-to-end contact forming a row of boards 23, a third pair of the boards is disposed so as to provide end-to-end contact forming a row of boards 23. The arrangement of boards for this embodiment provides course 20A with a width equal to the sum of the widths for three of the boards, where the board width is shown as B. The side edge 24 of the first pair of boards is laminated to the side edge 24 of the second pair of boards so as to provide tongue and groove coupling. The opposite side edge 24 of the second pair of boards is laminated to the third pair of boards so as to provide tongue and groove coupling. The ends of the first pair of boards are offset by an amount A from the ends of the second pair of boards. The ends of the second pair of boards are offset by an amount A from the ends of the third pair of boards. The pair of boards in each of the rows of boards 23 has a total length C, where C is a selected length measurement. Generally, the values for A, B, and C are a matter of designer choice. Preferably, the value for A is selected so as to facilitate producing a random pattern of board placements for the hardwood floor. In a preferred embodiment, the boards are about 3.5 feet long, about 2.25 inches wide, about 0.75 inch thick, and the offset for pairs of adjacent boards is about 6 inches. Also, preferred embodiments of the present invention further include an adhesive between the tongue and groove couplings and side edges for laminating the boards together.

In more preferred embodiments, an adhesive is applied between side edges 24 of the boards and the tongue and groove coupling is provided for laminating the boards together so that the boards are only held together by the adhesive. In other words, preferred embodiments of the present invention do not include a backing layer or a substrate for holding the boards together. Another embodiment of the present invention comprises a hardwood floor that includes the start or finish course as recited supra.

In preferred embodiments of the present invention, after installation of course 20A for starting a hardwood floor, the standard methods of installing hardwood floors can be used to install additional boards starting at edge 26 of course 20A. More specifically, additional boards are installed using standard techniques for installing separate boards and tools such as a standard floor nailer can be used for the separate boards. Similarly, upon nearing completion of the installation of the separate boards, course 20A can be used as the finishing course for installing the floor.

Figure 1B:
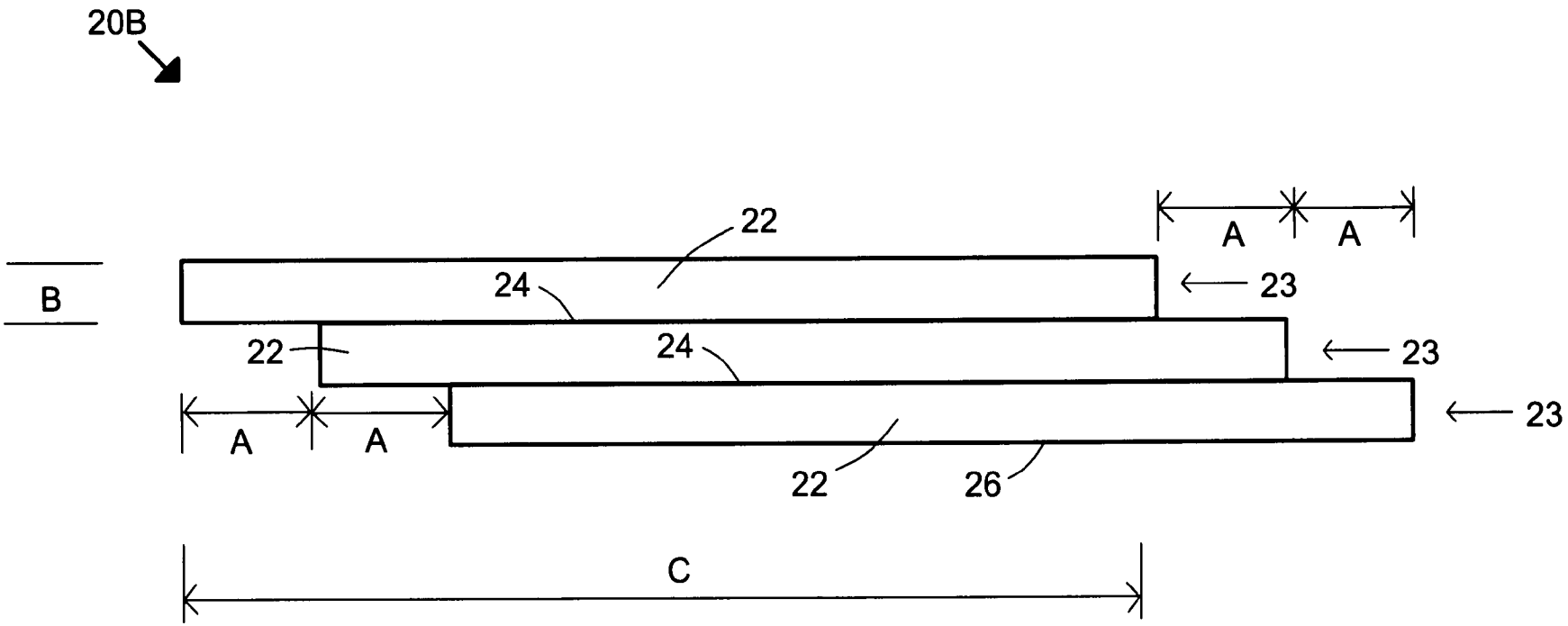
FIG. 1B is a diagram of a start course or finish course according to an embodiment of the present invention.

Reference is now made to FIG. 1B where there is shown a start or finish course 20B for a hardwood floor according to another embodiment of the present invention. Course 20B includes a first elongated hardwood tongue and groove board 22 and a second elongated hardwood tongue and groove board 22 with the side edge 24 of the first board being fastened to the side edge 24 of the second board so as to provide tongue and groove coupling. The ends of the first board are offset by an amount A, where A represents a selected distance, from the ends of the second board. A further embodiment further comprises a third board 22. The opposite side edge 24 of the second board is fastened to the third board so as to provide tongue and groove coupling. The ends of the second board 22 are offset by the amount A from the ends of the third board with the ends being offset in the same direction. Boards 22 have a width B, where be represents a selected width measurement. Board 22 also has a length C, where C is a selected length measurement. Generally, the values for A, B, and C are a matter of designer choice. Preferably, the value for A is selected so as to facilitate producing a random pattern of board placements for the hardwood floor.

Figure 1C:
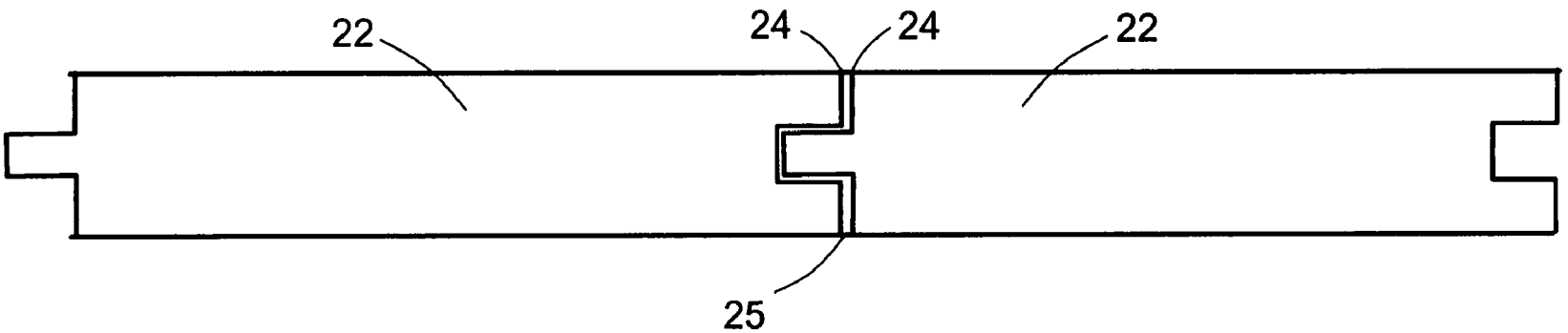
FIG. 1C is a diagram of an start course or finish course according to an embodiment of the present invention.

Reference is now made to FIG. 1C where there is shown a cross-section side view of a start or a finish course or a border course according to one embodiment of the present invention. FIG. 1C shows the cross-section of a preferred embodiment of the present invention that includes a board 22 in tongue and groove coupling with another board 22 along side edge 24. An amount of adhesive 25 is provided along side edge 24 and the tongue and groove coupling for laminating the boards together. The ends of the boards are offset as described for the first two rows of boards or first two boards described for FIG. 1A, FIG. 1B, FIG. 2A, and FIG. 3A. It is to be noted that embodiments of the present invention include start courses, finish courses, and border courses that include as few as two boards laminated together along one edge or as few as two rows of boards laminated together along one edge.

Figure 2:
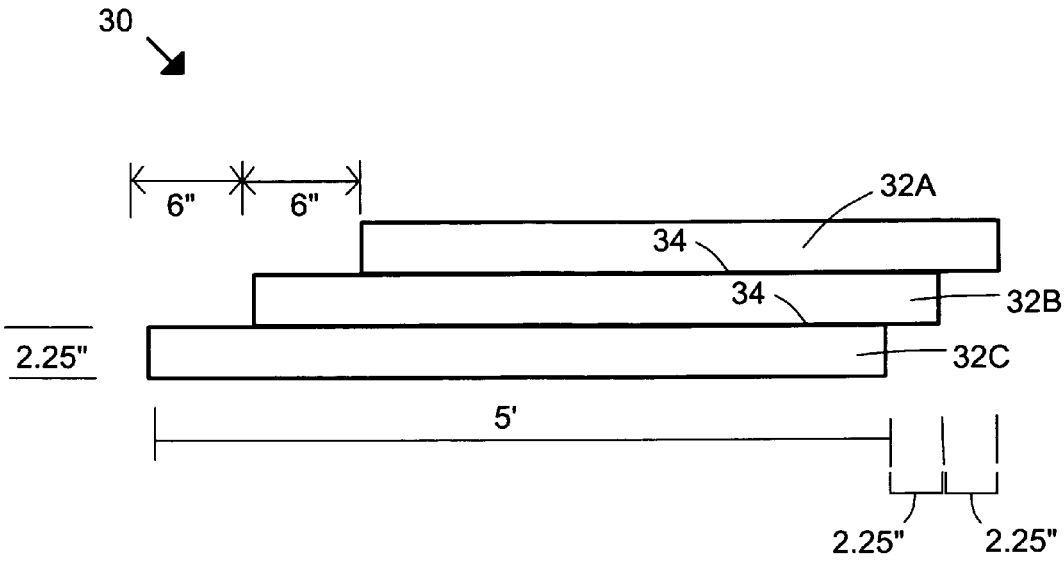
FIG. 2 is a diagram of a border course according to an embodiment of the present invention.
Figure 3:
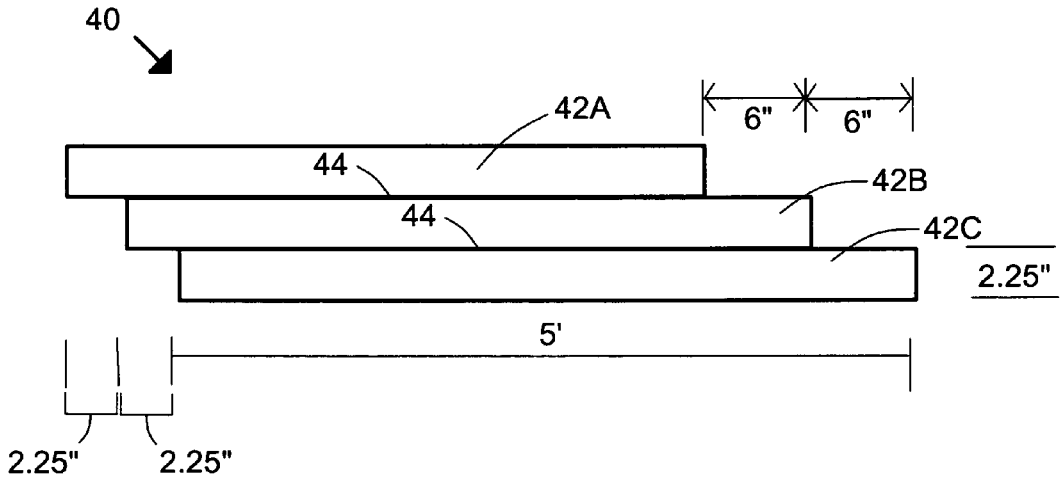
FIG. 3 is a diagram of a border course according to an embodiment of the present invention.

Reference is now made to FIG. 2 and FIG. 3 where there are shown top views of a border course according to embodiments of the present invention. FIG. 2 shows a configuration for a left border course 30 for a hardwood floor, and FIG. 3 shows a configuration for a right border course 40 for a hardwood floor.

For the embodiment shown in FIG. 2, border course 30 includes a hardwood tongue and groove elongated first board 32A, a hardwood tongue and groove elongated second board 32B, and a hardwood tongue and groove elongated third board 32C. The side edge 34 of the first board 32A is laminated to the side edge 34 of the second board so as to provide tongue and groove coupling. The opposite side edge 34 of the second board 32B is laminated to the third board 32C so as to provide tongue and groove coupling.

A first end of the first board 32A is offset by a first amount, such as 6 inches, from a first end of the second board 32B. The first end of the second board 32B is offset by the first amount, such as 6 inches, from a first end of the third board 32C. A second end of the first board 32A is offset by a second amount, such as 2.25 inches, from a second end of the second board 32B. The second end of the second board 32B is offset by the second amount, such as 2.25 inches, from the second end of the third board 32C.

In a preferred embodiment, the first board, second board, and third board are 2.25 inches wide and 0.75 inch thick; the first board is 5 feet long, the first amount is 6 inches and the second amount is 2.25 inches. Also, preferred embodiments of the present invention further include an adhesive between the tongue and groove couplings for laminating the boards together. In more preferred embodiments, an adhesive between side edges of the boards and the tongue and groove coupling is provided for laminating the boards together so that the boards are only held together by the adhesive. In other words, preferred embodiments of the present invention do not include a backing layer or a substrate for holding the boards together. Another embodiment of the present invention comprises a hardwood floor that includes the border course as recited supra.

The embodiment shown in FIG. 3 is analogous to the embodiment shown in FIG. 2. Border course 40 shown in FIG. 3 includes boards 42A, 42B, 42C, and edges corresponding to those for border course 30. The directions for the offsets for the embodiment in FIG. 3 are the opposite of those for the embodiment shown in FIG. 2.

For preferred embodiments, border courses according to the present invention are smaller in length than start courses and finish courses. Preferred embodiments of border courses have the longest board or the longest row of boards at a length of about 5 feet with a 2.25 inch offset on one side and a 6 inch offset on the other end in the same direction.

Figure 2A:
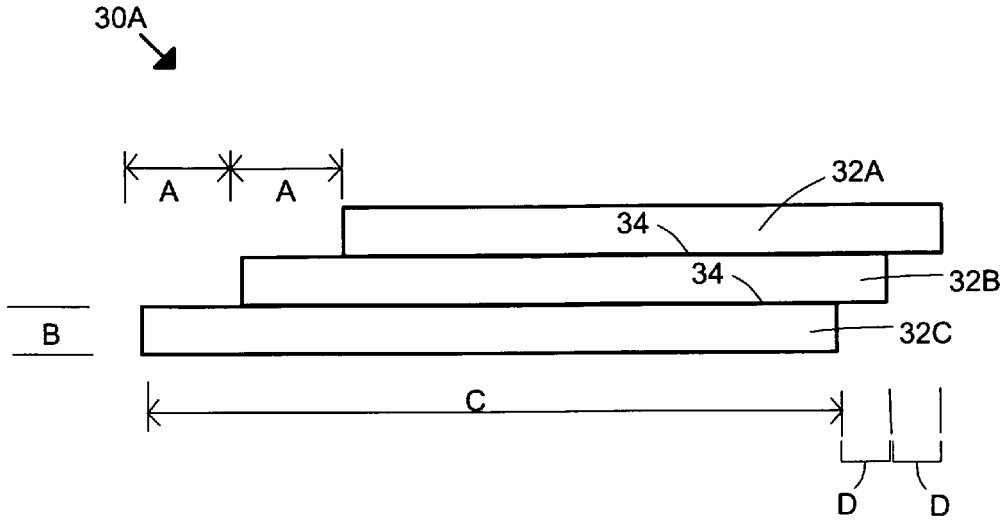
FIG. 2A is a diagram of a border course according to an embodiment of the present invention.
Figure 3A:
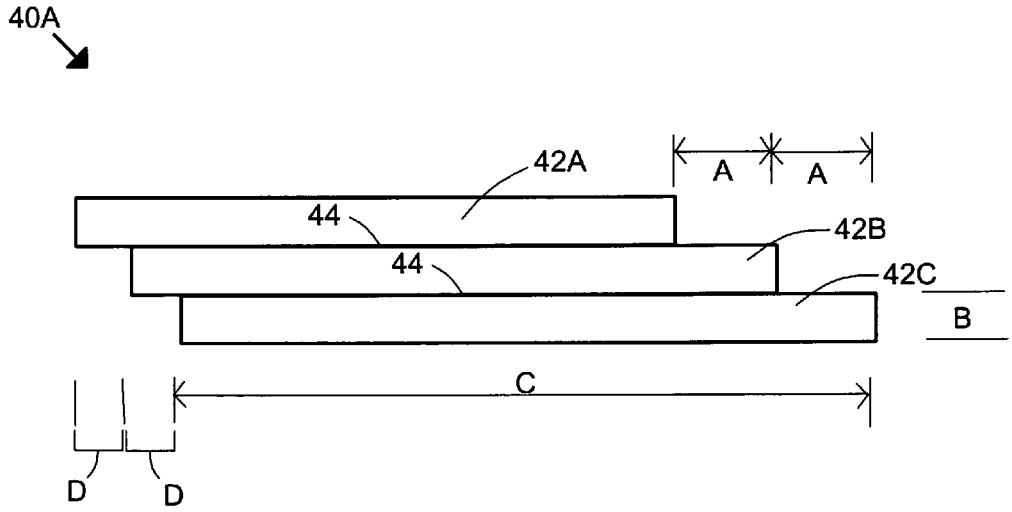
FIG. 3A is a diagram of a border course according to an embodiment of the present invention.

Reference is now made to FIG. 2A and FIG. 3A where there are shown top views of a border course according to embodiments of the present invention. FIG. 2A shows a configuration for a left border course 30 for a hardwood floor, and FIG. 3A shows a configuration for a right border course 40 for a hardwood floor.

For the embodiment shown in FIG. 2A, border course 30 includes a hardwood tongue and groove elongated first board 32A, a hardwood tongue and groove elongated second board 32B, and a hardwood tongue and groove elongated third board 32C. The side edge 34 of the first board 32A is laminated to the side edge 34 of the second board so as to provide tongue and groove coupling. The opposite side edge 34 of the second board 32B is laminated to the third board 32C so as to provide tongue and groove coupling.

A first end of the first board 32A is offset by a first amount A where A is a distance from a first end of the second board 32B. The first end of the second board 32B is offset by the first amount A from a first end of the third board 32C. A second end of the first board 32A is offset by a second amount D where D is a distance from a second end of the second board 32B. The second end of the second board 32B is offset by the second amount D from the second end of the third board 32C.

In a preferred embodiment, the first board, second board, and third board have a width of D and a thickness of E; the first board has a length of F. Also, preferred embodiments of the present invention further include an adhesive between the tongue and groove couplings for laminating the boards together. In more preferred embodiments, an adhesive between side edges of the boards and the tongue and groove coupling is provided for laminating the boards together so that the boards are only held together by the adhesive. In other words, preferred embodiments of the present invention do not include a backing layer or a substrate for holding the boards together. Another embodiment of the present invention comprises a hardwood floor that includes the border course as recited supra.

The embodiment shown in FIG. 3A is analogous to the embodiment shown in FIG. 2A. Border course 40A shown in FIG. 3A includes boards 42A, 42B, 42C, and side edges 44 corresponding to those for border course 30A. The directions for the offsets for the embodiment in FIG. 3A are the opposite of those for the embodiment shown in FIG. 2A.

For preferred embodiments, border courses according to the present invention are smaller in length than start courses and finish courses. Generally, the dimensions of A, B, C, D, E, and F used in FIG. 2A in FIG. 3A are a matter of designer choice; a wide variety of dimensions can be selected. Preferably, the dimensions are selected so as to allow easy and efficient installation of a hardwood floor while preserving an attractive random appearance for the pattern of boards.

Another aspect of the present invention includes a method of installing a hardwood floor at a jobsite. The method comprises the steps of: fabricating a course as described supra at a place other than the jobsite; transporting the course to the jobsite; and integrating the course as a portion of the hardwood floor. For preferred embodiments of the present invention, courses as described supra are fabricated in a manufacturing facility such as a factory for producing wood products.

Figure 4:
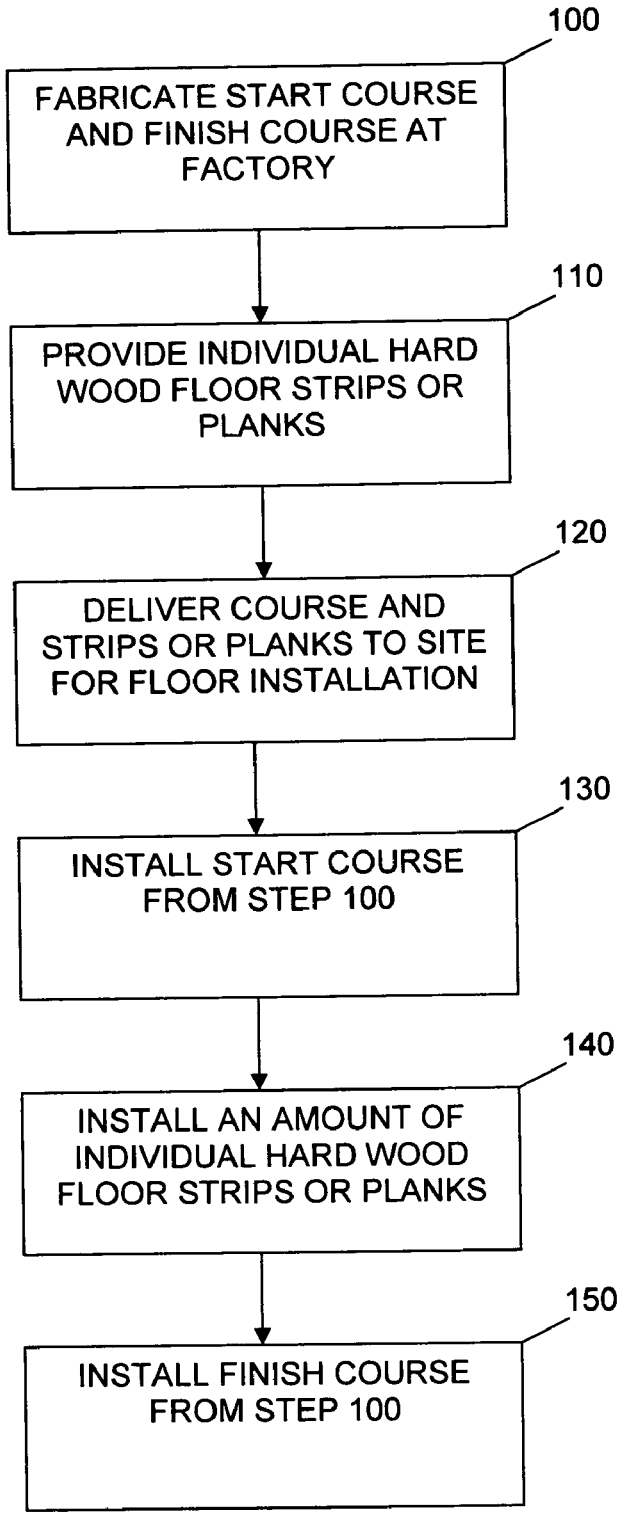
FIG. 4 is a flow diagram of steps for installing a hardwood floor according to an embodiment of the present invention.

A flowchart of steps for one embodiment of the present invention for installing a hardwood floor is shown in FIG. 4. Step 100 includes fabricating a start course and a finish course according to FIG. 1, FIG. 1A, FIG. 1B, and FIG. 1C, at a manufacturing facility such as a factory for producing wood products. Step 110 includes providing individual hardwood floor strips or planks such as standard strips or planks used for standard hardwood floor installations. Step 120 includes delivering the courses from step 100 and the strips or planks from step 110 to a site for the floor installation such as a jobsite. Step 130 includes installing the start course. Step 140 includes installing an amount of the individual hardwood strips or planks. Preferably, a sufficient amount of the individual hardwood strips or planks is installed to near completion of the floor installation. Step 150 includes installing the finish course from step 100 for completion of the floor installation. It is to be understood that for the method shown in FIG. 4, it may be necessary to use more than one start course and more than one finish course for the floor installation. Standard methods such as surface nailing or blind nailing can be used for the installation of the start and finish course for step 130 and step 150. Also, depending on the complexity of the floor installation, it may be preferred to install one or more border courses as described for embodiments of the present invention presented in FIGS. 2A and 3A.

Figure 5:
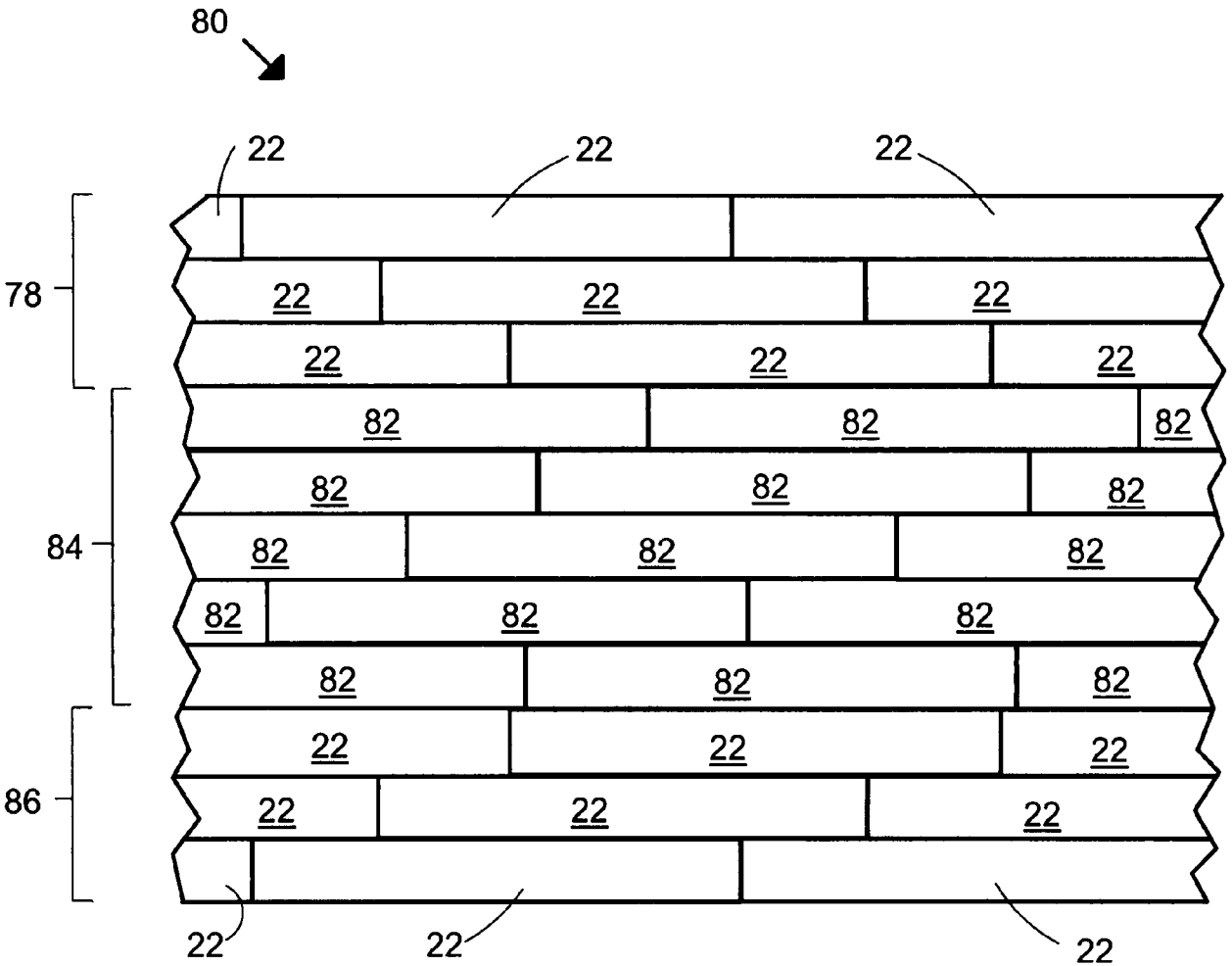
FIG. 5 is a diagram of a hardwood floor according to an embodiment of the present invention.

Reference is now made to FIG. 5 where there is shown a top view of a portion of a hardwood floor 80 according to one embodiment of the present invention. Hardwood floor 80 includes a first section 78 comprised of at least one start course 20A, a second section 84 comprised of an amount of individual hardwood planks or strips 82, and a third section 86 comprised of at least one finish course 20A. Start course 20A and finish course 20A included in section 78 and section 86 are substantially the same as course 20A described in FIG. 1A. Second section 84 of hardwood floor 80 is installed using standard techniques for installing standard strips or planks for hardwood floors. Start course 20A and finish course 20A can be installed in the hardwood floor using standard methods such as surface nailing and blind nailing.

The foregoing description was directed towards using hardwood planks or strips. It is to be understood that the use of hardwood planks or strips for the present invention represent a preferred embodiment and is not to be taken as a limitation for the present invention. More specifically, embodiments of the present invention can be practiced with hardwood planks or strips or with engineered flooring materials such as engineered flooring material that includes an engineered board with a hardwood surface layer attached. Engineered flooring materials suitable for embodiments of the present invention are known and are commercially available.

Figure 6:
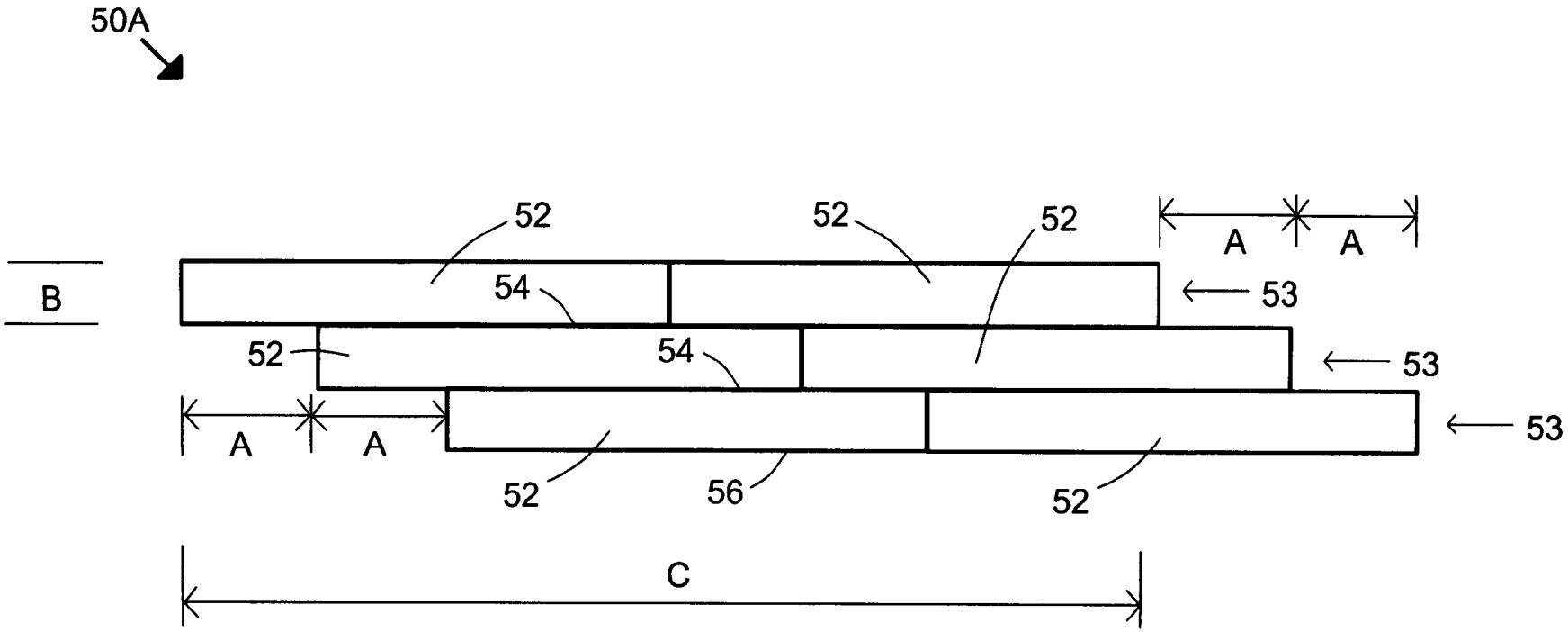
FIG. 6 is a diagram of a start course or finish course according to an embodiment of the present invention.

Reference is now made to FIG. 6 where there is shown a top view of a start or finish course 50A according to one embodiment of the present invention. Course 50A includes engineered flooring material comprising engineered boards 52 with a layer of hardwood on the top surface. Boards 52 are configured in substantially the same way as the hardwood boards for the embodiments described in FIG. 1, FIG. 1A, FIG. 1B, and FIG. 1C. More specifically, the dimensions and offsets for course 50A are substantially as described for the embodiment shown in FIG. 1A and boards 52 are fastened together, preferably by lamination, at side edge 54.

Figure 7:
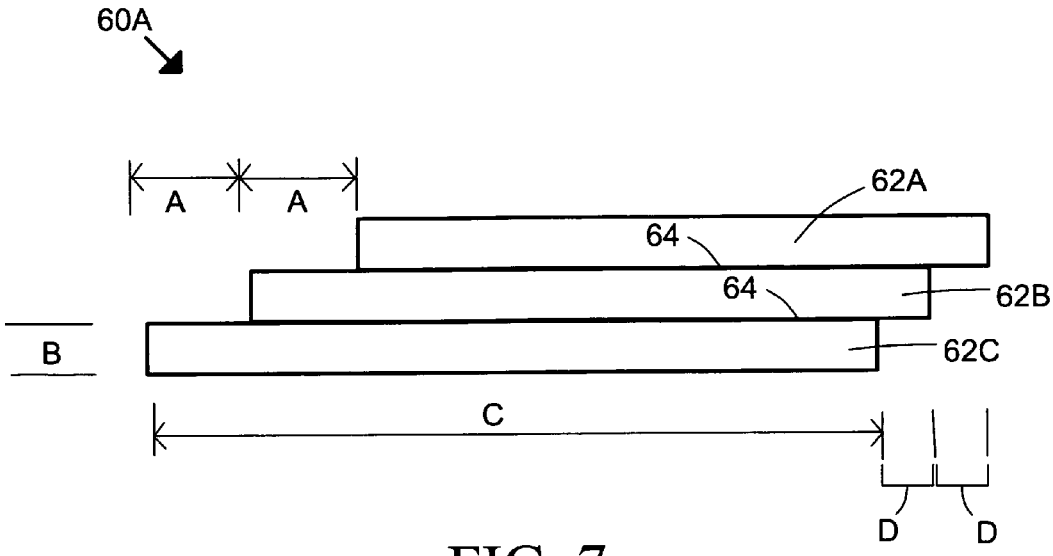
FIG. 7 is a diagram of a border course according to an embodiment of the present invention.
Figure 8:
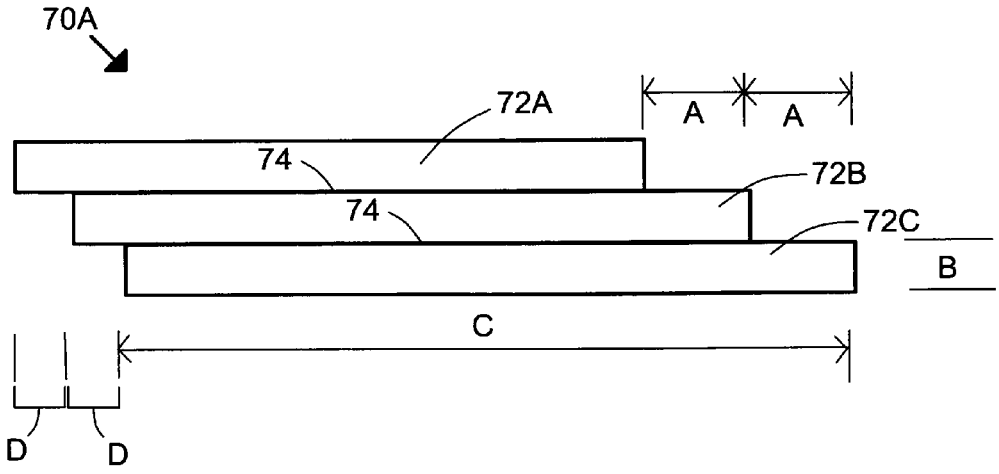
FIG. 8 is a diagram of a border course according to an embodiment of the present invention.

As an option, engineered flooring material can also be used for embodiments of border courses substantially the same as those described for the embodiments described in FIG. 2, FIG. 3, FIG. 2A, and FIG. 3A with the exception that the hardwood strips or planks are replaced with engineered flooring material having dimensions substantially the same as the dimensions as the hardwood strips or planks. Examples of border courses that include engineered flooring material according to embodiments of the present invention are shown in FIG. 7 and FIG. 8. Border course 60A shown in FIG. 7 and border course 70A shown in FIG. 8 are substantially the same as the courses shown in FIG. 2A and FIG. 3A, respectively, with the exception that boards 62A, 62B, 62C, 72A, 72B, and 72C comprise engineered flooring material such as engineered boards with a top layer of hardwood or a hardwood veneer. The boards shown in FIG. 7 and FIG. 8 are fastened together along side edge 64 and side edge 74, respectively.

Preferred embodiments of the present invention may include boards that are Pre-Finished material or can be used with any plank over 2.25 inches wide.

Start or finish courses according to embodiments of the present invention, when installed at the beginning of any floor or the end of any floor, will require shorter installation time and the resulting hardwood floor will have fewer gaps than obtained using standard hardwood floor installation methods and apparatuses. Embodiments of the present invention are particularly useful around toe kicks of cabinets and can be used in small closets or in tight spaces.

Prototypes of embodiments of the present invention have been fabricated. Some of the prototypes have been used in time trials for installing hardwood floors. The results of one of the tests showed that each board installed saved approximately 15 minutes of labor as compared to the standard method of installation for standard hardwood floors.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Further, unless expressly stated to the contrary, "at least one of" is to be interpreted to mean "one or more." For example, a process, method, article, or apparatus that comprises one or more of a list of elements and if one or more of the elements comprises a sub-list of sub-elements, then the sub-elements are to be considered in the same manner as the elements. For example, at least one of A and B is satisfied by any one of the following: A is true (or present) and B is false (or not present), A is false (or not present) and B is true (or present), and both A and B are true (or present).

Furthermore, a process, method, article, or apparatus that comprises one or more of a list of elements and if one or more of the elements comprises a sub-list of sub-elements, then the "at least one" is to be interpreted to mean "one or more" of the elements and sub-elements where the elements and sub-elements are to be considered part of one group of equal members. For example, at least one of A and B, where A is a list of sub-elements a1, a2, and a3, is satisfied by any one of the following: any sub-element of A is true (or present) and B is false (or not present), any of or all of the sub-element(s) of A is false (or not present) and B is true (or present), and both any sub-element of A and B are true (or present). For example, at least one of A and B, where A is a list of sub-elements a1, a2, and a3 and B is a list of sub-elements b1, b2, and b3, is satisfied by any one of the following: any sub-element of A is true (or present) and any sub-element of B is false (or not present), any sub-element of A is false (or not present) and any sub-element of B is true (or present), and both any sub-element of A and any sub-element of B are true (or present).

What is claimed is:

1. A hardwood flooring system for a room, the hardwood flooring system comprising:

an adhesive;

a start course, the start course comprising a first pair of hardwood tongue and groove boards being disposed so as to provide end-to-end contact, a second pair of hardwood tongue and groove boards being disposed so as to provide end-to-end contact, a third pair of hardwood tongue and groove boards being disposed so as to provide end-to-end contact, the side edge of the first pair of boards being fastened to the side edge of the second pair of boards so as to provide tongue and groove coupling laminated together with the adhesive disposed therebetween, the opposite side edge of the second pair of boards being fastened to the third pair of boards so as to provide tongue and groove coupling laminated together with the adhesive disposed therebetween, the ends of the first pair of boards being offset by an amount from the ends of the second pair of boards, the ends of the second pair of boards being offset by the amount from the ends of the third pair of boards, the ends being offset in the same direction, the start course being without a substrate or backing;

a plurality of individual hardwood strips or planks; and a finish course, the finish course comprising a first pair of hardwood tongue and groove boards being disposed so as to provide end-to-end contact, a second pair of hardwood tongue and groove boards being disposed so as to provide end-to-end contact, a third pair of hardwood tongue and groove boards being disposed so as to provide end-to-end contact, the side edge of the first pair of boards being fastened to the side edge of the second pair of boards so as to provide tongue and groove coupling laminated together with the adhesive disposed therebetween, the opposite side edge of the second pair of boards being fastened to the third pair of boards so as to provide tongue and groove coupling laminated together with the adhesive disposed therebetween, the ends of the first pair of boards being offset by an amount from the ends of the second pair of boards, the ends of the second pair of boards being offset by the amount from the ends of the third pair of boards, the ends being offset in the same direction; the finish course being without a substrate or backing;

the start course being positioned along one side of the room and held by blind nailing and/or surface nailing, the plurality of individual hardwood strips or planks being positioned starting at the edge of the start course and held in place by blind nailing using a standard floor nailer to a distance from the opposite side of the room about the width of the finish course, the plurality of individual hardwood strips or planks being held together without the adhesive, the finish course being positioned along the opposite side of the room and held by blind nailing and/or surface nailing.

2. The system of claim 1, wherein the start course or finish course comprises 6 boards, the boards are about 3.5 feet (1.07 meters) long, about 2.25 inches (0.057 meters) wide, about 0.75 inch (0.019 meters) thick, the offset for pairs of adjacent boards is about 6 inches and the boards are fastened by lamination.

3. A hardwood flooring system for a room, the hardwood flooring system comprising:

an adhesive;

a border course, the border course comprising a hardwood tongue and groove elongated first board, a hardwood tongue and groove elongated second board, and a hardwood tongue and groove elongated third board, the side edge of the first board being fastened to the side edge of the second board so as to provide tongue and groove coupling laminated together with the adhesive disposed therebetween, the opposite side edge of the second board being fastened to the third board so as to provide tongue and groove coupling laminated together with the adhesive disposed therebetween, a first end of the first board being offset by a first amount in a direction from a first end of the second board, the first end of the second board being offset by the first amount from a first end of the third board, a second end of the first board being offset by a second amount from a second end of the second board, the second end of the second board being offset by the second amount from the second end of the third board, the ends being offset in the same direction; the border course being without a substrate or backing; and a plurality of individual hardwood strips or planks;

the border course being positioned along one side of the room and held by blind nailing and/or surface nailing, the plurality of individual hardwood strips or planks being positioned starting at the edge of the border course and held in place by blind nailing using a standard floor nailer, the plurality of individual hardwood strips or planks being held together without the adhesive.

4. The system of claim 3, wherein the first board, second board, and third board are 2.25 inches (0.057 meters) wide and 0.75 inch (0.019 meters) thick; the first board is 5 feet (1.52 meters) long, the first amount is 6 inches (0.15 meters), the second amount is 2.25 inches (0.057 meters), and the boards are fastened by lamination.

5. A method of installing a hardwood floor system, the method comprising:

providing a start course, the start course comprising an adhesive, a first pair of hardwood tongue and groove boards being disposed so as to provide end-to-end contact, a second pair of hardwood tongue and groove boards being disposed so as to provide end-to-end contact, a third pair of hardwood tongue and groove boards being disposed so as to provide end-to-end contact, the side edge of the first pair of boards being fastened to the side edge of the second pair of boards so as to provide tongue and groove coupling laminated together with the adhesive disposed therebetween, the opposite side edge of the second pair of boards being fastened to the third pair of boards so as to provide tongue and groove coupling laminated together with the adhesive disposed therebetween, the ends of the first pair of boards being offset by an amount from the ends of the second pair of boards, the ends of the second pair of boards being offset by the amount from the ends of the third pair of boards, the ends being offset in the same direction, the start course being without a substrate or backing;

providing a plurality of individual hardwood strips or planks;

providing a finish course, the finish course comprising an adhesive, a first pair of hardwood tongue and groove boards being disposed so as to provide end-to-end contact, a second pair of hardwood tongue and groove boards being disposed so as to provide end-to-end contact, a third pair of the boards being disposed so as to provide end-to-end contact, the side edge of the first pair of boards being fastened to the side edge of the second pair of boards so as to provide tongue and groove coupling laminated together with the adhesive disposed therebetween, the opposite side edge of the second pair of boards being fastened to the third pair of boards so as to provide tongue and groove coupling laminated together with the adhesive disposed therebetween, the ends of the first pair of boards being offset by an amount from the ends of the second pair of boards, the ends of the second pair of boards being offset by the amount from the ends of the third pair of boards, the ends being offset in the same direction; the start finish course being without a substrate or backing;

positioning the start course along one side of the room and using a standard floor nailer to blind nail the start course in place;

positioning the plurality of individual hardwood strips or planks beginning at a position starting at the edge of the start course;

using a standard floor nailer to blind nail each one of the plurality of individual hardwood strips or planks in place to a distance from the opposite side of the room about the width of the finish course; positioning the finish course along the opposite side of the room; and holding the finish course in place by blind nailing and/or surface nailing.

6. The method of claim 5, wherein the start course or finish course comprises 6 boards, the boards are about 3.5 feet (1.07 meters) long, about 2.25 inches (0.057 meters) wide, about 0.75 inch (0.019 meters) thick, the offset for pairs of adjacent boards is about 6 inches and the boards are fastened by lamination.

7. A method of installing a hardwood floor system, the method comprising:

providing a border course, the border course comprising an adhesive, a hardwood tongue and groove elongated first board, a hardwood tongue and groove elongated second board, and a hardwood tongue and groove elongated third board, the side edge of the first board being fastened to the side edge of the second board so as to provide tongue and groove coupling laminated together with the adhesive disposed therebetween, the opposite side edge of the second board being fastened to the third board so as to provide tongue and groove coupling laminated together with the adhesive disposed therebetween, a first end of the first board being offset by a first amount in a direction from a first end of the second board, the first end of the second board being offset by the first amount from a first end of the third board, a second end of the first board being offset by a second amount from a second end of the second board, the second end of the second board being offset by the second amount from the second end of the third board, the ends being offset in the same direction; the border course being without a substrate or backing; and providing a plurality of individual hardwood strips or planks;

positioning the border course along one side of the room;

using a standard floor nailer to blind nail the border course in place;

positioning the plurality of individual hardwood strips or planks starting at the edge of the border course; and using a standard floor nailer to blind nail each of the plurality of individual hardwood strips or planks in place so as to hold the plurality of individual hardwood strips or planks together without adhesive.

8. The course of claim 7, wherein the first board, second board, and third board are 2.25 inches (0.057 meters) wide and 0.75 inch (0.019 meters) thick; the first board is 5 feet (1.52 meters) long, the first amount is 6 inches (0.15 meters), the second amount is 2.25 inches (0.057 meters), and the boards are fastened by lamination.

* * * * *

UNITED STATES PATENT AND TRADEMARK OFFICE

CERTIFICATE OF CORRECTION

PATENT NO. : 8,225,574 B2
APPLICATION NO. : 11/581019
DATED : July 24, 2012
INVENTOR(S) : Wesley J. Croskrey It is certified that error appears in the above-identified patent and that said Letters Patent is hereby corrected as shown below:

In the Claims:

Column 12, line 21, the portion of the text reading "8. The course of claim" should read --8. The method of claim--.

Signed and Sealed this
Ninth Day of July, 2013

Teresa Stanek Rea
*Acting Director of the United States Patent and Trademark Office*